US007308862B2

(12) United States Patent
Romanski et al.

(10) Patent No.: US 7,308,862 B2
(45) Date of Patent: Dec. 18, 2007

(54) COATING FOR A FLEXIBLE FLUID CONTAINMENT VESSEL AND A METHOD OF MAKING THE SAME

(75) Inventors: Eric Romanski, Clifton Park, NY (US); Crayton Gregory Toney, Wrentham, MA (US); Joseph G. O'Connor, Hopedale, MA (US); Maurice R. Paquin, Plainville, MA (US)

(73) Assignee: Albany International Corp., Albany, NY (US)

( * ) Notice: Subject to any disclaimer, the term of this patent is extended or adjusted under 35 U.S.C. 154(b) by 997 days.

(21) Appl. No.: 09/923,936

(22) Filed: Aug. 7, 2001

(65) Prior Publication Data

US 2003/0019418 A1 Jan. 30, 2003

Related U.S. Application Data

(63) Continuation-in-part of application No. 09/908,877, filed on Jul. 18, 2001, which is a continuation-in-part of application No. 09/832,739, filed on Apr. 11, 2001.

(51) Int. Cl.
*B63B 25/08* (2006.01)

(52) U.S. Cl. ..... 114/74 T

(58) Field of Classification Search ..... 114/74 T, 114/256; 383/105, 116, 117; 428/313.5, 428/36.1, 36.2; 442/79, 85, 86, 168, 170
See application file for complete search history.

(56) References Cited

U.S. PATENT DOCUMENTS 34,426 A 2/1862 Howard
389,615 A 9/1888 Townsend
1,723,307 A 8/1929 Sipe
1,921,015 A 8/1933 Young
2,065,480 A 12/1936 Soper
2,371,404 A 3/1945 Mumford
2,391,926 A 1/1946 Scott
2,492,699 A 12/1949 Houwink
2,685,964 A 8/1954 Brown (Continued)

FOREIGN PATENT DOCUMENTS

DE 198 21 465 A 11/1999

(Continued)

OTHER PUBLICATIONS

*McGraw-Hill Encyclopedia of Science of Technology, 6th Edition*, 1987, McGraw-Hill Book Company, New York XP00220369918, pp. 247-248 Paragraph 4; figures 6-8.

(Continued)

*Primary Examiner*—Ed Swinehart
(74) *Attorney, Agent, or Firm*—Frommer Lawrence & Haug LLP; Ronald R. Santucci

(57) ABSTRACT

A flexible fluid containment vessel fabricated out of fabric for transporting and containing a large volume of fluid, particularly fresh water, with the fabric being made from coated thermoplastic yarns or fiber such that its respective sides have coatings so formed thereon that are different from each other or the fabric is coated with voids such that its overall density of the coated fabric is less than 1 g/cm$^3$ allowing it to float.

8 Claims, 7 Drawing Sheets

U.S. PATENT DOCUMENTS 2,724,358 A 11/1955 Harris et al.
2,725,027 A 11/1955 Brandon et al.
2,794,192 A 6/1957 Paris
2,854,049 A 9/1958 Wyllie
2,968,272 A 1/1961 Berglund
2,979,008 A 4/1961 Whipple
2,997,973 A 8/1961 Hawthorne et al.
2,998,793 A 9/1961 Hawthorne et al.
3,001,501 A 9/1961 Hawthorne et al.
3,018,748 A 1/1962 Denis et al.
3,056,373 A 10/1962 Hawthorne et al.
3,067,712 A 12/1962 Koerpinghaus
3,150,627 A 9/1964 Stewart et al.
3,167,103 A 1/1965 Hawthorne et al.
3,224,403 A 12/1965 Paddington
3,282,361 A 11/1966 Mackie
3,289,721 A 12/1966 Benson
3,296,994 A 1/1967 Schirtzinger
3,502,046 A 3/1970 Stauber
3,622,437 A 11/1971 Hobaica et al.
3,661,693 A 5/1972 Pierson
3,672,319 A 6/1972 Platzer
3,739,410 A 6/1973 Fortin
3,762,108 A 10/1973 Pierson
3,774,563 A 11/1973 Anderson, Sr. et al.
3,779,196 A 12/1973 Knaus et al.
3,797,445 A 3/1974 Zeimer
3,812,805 A 5/1974 Forssell et al.
3,839,977 A 10/1974 Bradberry
3,885,077 A * 5/1975 Lederman ..... 442/171
3,952,679 A 4/1976 Grihangne
3,955,524 A 5/1976 Renoux
3,974,789 A 8/1976 de Groot
4,016,326 A 4/1977 Schaefer
4,108,101 A 8/1978 Schirtzinger
4,226,906 A 10/1980 Jacob
4,227,474 A 10/1980 Ullrich
4,227,477 A 10/1980 Preus
4,227,478 A 10/1980 Preus
4,230,061 A 10/1980 Roberts et al.
4,373,462 A 2/1983 Fish
4,399,765 A 8/1983 Alkner et al.
4,506,623 A 3/1985 Roper et al.
4,509,558 A 4/1985 Slater
4,510,201 A 4/1985 Takeuchi et al.
4,582,756 A 4/1986 Niinuma et al.
4,662,386 A 5/1987 Pedersen
4,726,986 A 2/1988 Cannady, Jr. et al.
4,897,303 A * 1/1990 McCullough, Jr. et al. ... 442/60
4,910,817 A 3/1990 Kita
4,933,231 A 6/1990 Seber
4,948,658 A 8/1990 Halker
4,983,433 A 1/1991 Shirasaki
4,998,498 A 3/1991 Gallichan
5,082,726 A 1/1992 Bastiaens et al.
5,194,459 A 3/1993 Sato et al.
5,203,272 A 4/1993 Kassinger et al.
5,235,928 A 8/1993 Shank, Jr.
5,238,537 A 8/1993 Dutt
5,243,925 A 9/1993 Fortenberry
5,262,230 A 11/1993 Becker et al.
5,355,819 A 10/1994 Hsia et al.
5,360,656 A 11/1994 Rexfelt et al.
5,368,395 A * 11/1994 Crimmins ..... 383/107
5,391,424 A 2/1995 Kolzer
5,395,682 A 3/1995 Holland et al.
5,413,065 A 5/1995 Spragg et al.
5,421,128 A 6/1995 Sharpless et al.
5,431,970 A 7/1995 Broun et al.
5,482,763 A 1/1996 Shaffer
5,488,921 A 2/1996 Spragg
5,503,291 A 4/1996 Craig
5,505,557 A 4/1996 Bradley
5,512,356 A 4/1996 Haager
5,544,612 A 8/1996 Eymard
5,657,714 A 8/1997 Hsia et al.
5,691,390 A 11/1997 Harrison et al.
5,713,399 A 2/1998 Collette et al.
5,735,083 A 4/1998 Brown et al.
5,766,391 A 6/1998 Fletcher
5,780,144 A 7/1998 Bradley
5,790,304 A 8/1998 Sanders et al.
5,865,045 A 2/1999 Wagner et al.
5,902,070 A 5/1999 Bradley
5,921,421 A 7/1999 Fuquan
5,951,345 A 9/1999 Perratone et al.
6,003,565 A 12/1999 Whittier, II et al.
6,047,655 A 4/2000 Cran
6,056,438 A 5/2000 Bradley
6,086,968 A 7/2000 Horovitz
6,101,964 A 8/2000 Lesesne
6,290,818 B1 9/2001 Romanski

FOREIGN PATENT DOCUMENTS

EP 0 134 706 A 3/1985
EP 0 710 736 A1 11/1994
EP 0 687 625 12/1995
EP 0 862 870 A 9/1998
EP 0 832 032 B1 4/1999
FR 2 325 837 4/1977
FR 2595621 9/1987
GB 824 984 A 12/1959
GB 826 301 A 12/1959
GB 907 266 10/1962
GB 933 889 A 8/1963
GB 1 079 766 8/1967
GB 1117552 6/1968
GB 1117553 6/1968
JP 60 219243 A 11/1985
WO WO 97/14622 A 4/1997
WO WO 97/49541 12/1997
WO WO 98/01359 A 1/1998
WO WO 01 63033 8/2001

OTHER PUBLICATIONS

"3-D Braided Composites—Design and Applications" by D. Brookstein, 6th European Conference on Composite Materials, Sep. 1993, pp. 225-230.
Pages from web site of Bradley Textiles, Inc.
International Search Report issued by European Patent Office on Jul. 9, 2002 for PCT/US02/10694 filed Apr. 5, 2002.
International Search Report issued by the European Patent Office on Feb. 6, 2003 for PCT/US02/34299.
International Search Report issued by the European Patent Office on Feb. 10, 2003 for PCT/US02/34052.
International Search Report issued by the European Patent Office on Mar. 12, 2003 for PCT/US02/34004.

* cited by examiner

COATING FOR A FLEXIBLE FLUID CONTAINMENT VESSEL AND A METHOD OF MAKING THE SAME

CROSS-REFERENCE TO RELATED APPLICATIONS

This application is a continuation-in-part of U.S. Ser. No. 09/908,877 filed Jul. 18, 2001 entitled "Spiral Formed Flexible Fluid Containment Vessel" the disclosure of which is incorporated by reference herein which is a continuation-in-part of U.S. Ser. No. 09/832,739 filed Apr. 11, 2001 entitled "Flexible Fluid Containment Vessel" the disclosure of which is incorporated by reference herein.

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and a method of making the same.

BACKGROUND OF THE INVENTION

The use of flexible containers for the containment and transportation of cargo, particularly fluid or liquid cargo, is known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, a seamed structure is an alternative to a simple woven fabric as it would have different advantages thereto, particularly in the fabrication thereof.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips.

The length of fabric will be determined by the length of each spiral turn of the fabric strip of yarn material and its width determined by the number of spiral turns.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of non-woven material or of non-woven material with melting fibers.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

Furthermore, while as aforenoted, a seamless flexible container is desirable and has been mentioned in the prior art, the means for manufacturing such a structure has its difficulties. Heretofore, as noted, large flexible containers were typically made in smaller sections which were sewn or bonded together. These sections had to be water impermeable. Typically such sections, if not made of an impermeable material, could readily be provided with such a coating prior to being installed. The coating could be applied by conventional means such as spraying or dip coating.

Another problem is when the container is empty, since it is typically denser than salt water, it will sink in the absence of cargo. Devices that add buoyancy may be affixed to the container to prevent this.

In addition, due to the sinking during emptying of the cargo, because of this, in the absence of such devices the container may tend to bow in the middle which is undesirable.

SUMMARY OF THE INVENTION

It is therefore a principal object of the invention to provide for a relatively large fabric FFCV for the transportation of cargo, including, particularly, fresh water, having a density less than that of salt water and being so formed so as to be impervious to salt water and salt water ions.

It is a further object of the invention to provide for such an FFCV which has means of rendering the FFCV buoyant, particularly when empty without the need for buoyancy devices.

These and other objects and advantages will be realized by the present invention. In this regard the present invention envisions the use of a woven or spirally formed tube to create the FFCV, having a length of 300' or more and a diameter of 40' or more. Such a large structure can be fabricated on machines that make papermaker's clothing. The ends of the tube, sometimes referred to as the nose and tail, or bow and stern, may be sealed by a number of means, including being pleated, folded or otherwise reduced in diameter and bonded, stitched, stapled or maintained by a mechanical coupling or other means set forth in the aforesaid applications.

As aforenoted, the rendering of such a large vessel impervious to salt water and salt water ions, especially one formed seamless has its difficulties. In the aforesaid second application, means to accomplish this are disclosed. The present invention expands upon this and allows for different coatings to be incorporated into the FFCV. In addition, the present invention discloses coating methods which serve not only to render the fabric of the FFCV impervious but also buoyant with or without cargo (i.e. fresh water).

In the first aspect of the invention, it provides for a fabric making up the FFCV having a coated face or outside and back or inside with a thermoplastic material which may be different. The advantage of having different coatings on the inside and outside can be for a multitude of reasons. For example, it may be desirable to include a UV protecting ingredient in or on the outer coating. The coating selected may be influenced by this. On the inside there would be no need for a UV protection. However, it may be desirable to include a germicide or fungicide in or on the inside coating. Again, the coating selection may be influenced by this.

Other considerations may come into play as to the advantage of different coatings on the FFCV which will be apparent to a skilled worker in the art.

Such a coating arrangement may be implemented by applying coating to the fiber or yarn that makes up the fabric prior to the weaving thereof. In this regard, the face fibers may be coated with one type of thermoplastic compound with the back fibers coated with a different thermoplastic compound. The weaving process selectively interlaces all fibers with one type coating on one side and with the other coating on the other side. The structure is then heat treated under pressure to enable the thermoplastic coating to liquify and render the fabric impermeable. The different coatings predominantly stay on the sides of the fibers where they originated from.

We turn now to further ways to implement a coating of the fabric with additional attendant advantages. In this regard, the present invention envisions providing a coating that not only renders the fabric impermeable, but also allows the FFCV to float due the buoyant nature of the coating. A first way is to spray coat the fabric with the desired coating. In this regard, the desired result is to create an FFCV which includes the fabric and coating which has an overall density of less than that of salt water which is approximately 1.0 g/cm$^3$.

Accordingly, decreasing the overall density can be effected in the following ways. By incorporating microspheres (which may be glass, polymers, or other material suitable for purpose) in the coating, it creates voids in the coating, albeit small ones. Sufficient amounts of microspheres are added such that the density of the coating is reduced to less than 1.0 g/cm$^3$. The amount the density is reduced will also be dictated by the density of the woven fibers and the desired physical properties of the coating. For example, if the fibers used will themselves float uncoated, then the coating density need only be reduced sufficiently that it will float. In such an instance, the composite structure or coated fabric will naturally float.

If, however, the fibers used do not themselves float, then the density of the coating could be adjusted to compensate for the added density of the fibers such that the overall density of the composite structure is less than 1.0 g/cm$^3$.

Of course, in doing so, the desired mechanical characteristics of the coating should not be compromised beyond that required for an effective FFCV. For example, sufficient tensile strength, flexibility and abrasion resistance of the coating should be maintained to the degree necessary, as will be apparent to one skilled in the art.

Turning now briefly to a further means to provide for an FFCV with sufficient buoyancy, in this regard it again relates to the coating used to render the fabric impervious. In addition to creating a foam coating in the traditional manner, it has been found, quite unexpectedly, that air entrained in the spraying of the coating onto the fabric results in air bubbles within the coated fabric. Such air bubbles lower the density of the coating which, if to a sufficient degree, allows the coated fabric to be buoyant. The air bubbles were found to be both random in size and location and varied due to spraying conditions. The randomness of such voids may serve to minimize, to a certain degree, the effect that they may have on the mechanical characteristics as aforediscussed.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENTS

Figure 1:
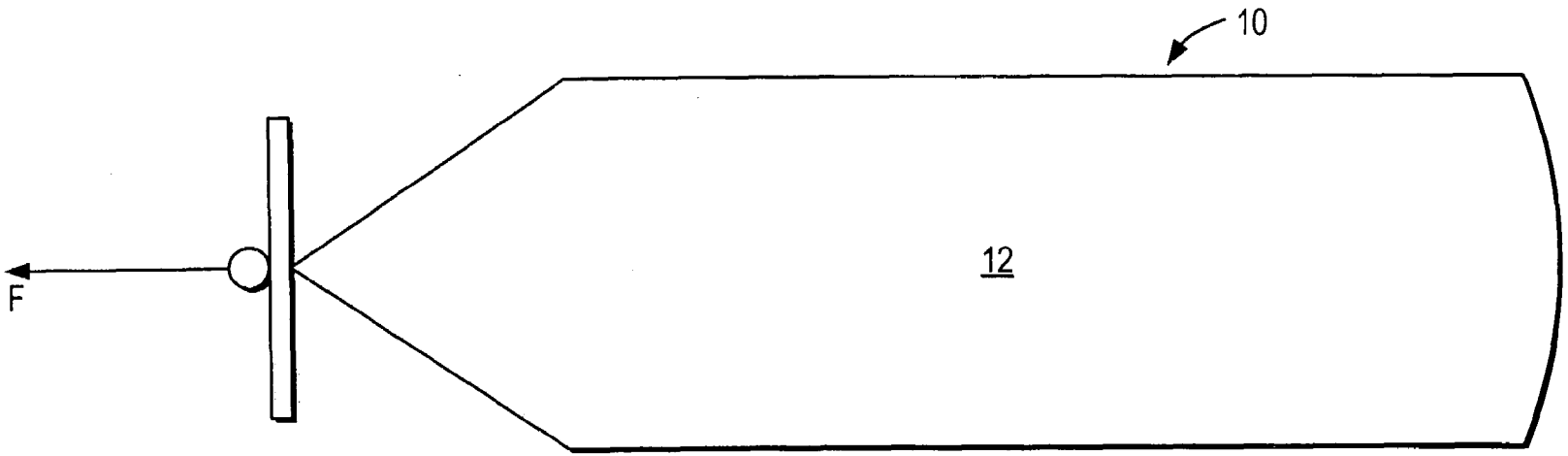
FIG. 1 is a somewhat general perspective view of an FFCV which is cylindrical having a pointed bow or nose.

The proposed FFCV 10 is intended to be constructed of a seamless woven impermeable textile tube 12. The tube's configuration may vary. For example, it would comprise a tube having a substantially uniform diameter (perimeter) and sealed on each end as shown in FIG. 1. It can also have a non-uniform diameter or non-uniform shape. The respective ends may be closed, pinched, and sealed in any number of ways. The resulting coated structure will also be flexible enough to be folded or wound up for transportation and storage.

The aforesaid patent applications discuss design consideration, material used, features and advantages of certain constructions, among other things, and will not be repeated herein. In general however, the material used will be briefly discussed.

Since the FFCV will experience cycling between no load and high load, the material's recovery properties in a cyclical load environment should be considered in any selection of material. The materials must also withstand exposure to sunlight, salt water, salt water temperatures, marine life and the cargo that is being shipped. The materials of construction must also prevent contamination of the cargo by the salt water. Contamination would occur, if salt water were forced into the cargo or if the salt ions were to diffuse into the cargo.

The present invention envisions the fabrication of very large FFCVs which are constructed from coated textiles. Coated textiles have two primary components. These components are the fiber reinforcement and the polymeric coating. A variety of fiber reinforcements and polymeric coating materials are suitable for FFCVs. Such materials must be capable of handling the mechanical loads and various types of extensions which will be experienced by the FFCV. Such materials, particularly the coating used, should also be abrasion resistant, since it will probably come in contact with objects during towing. Also, since it is envisioned that the FFCV be collapsed and wound onto a reel, it will come into contact with surfaces of the towing vessel when it is wound and unwound, so the material selected should be resistant to abrasion as a result of such contact. In addition, the materials used should be selected with the cargo being transported being taken into consideration. For example, if the cargo is potable water, the materials used, particularly the coating on the inside of the FFCV, should be acceptable for use with potable water. The coating used may even be the subject of approval by a governmental agency such as the FDA, if the potable water is to be used within its jurisdiction, or if not, a government agency of a foreign country where such water is to be used. Accordingly, a coating which might leach harmful chemicals or otherwise contaminate the cargo should not be used on the inside of the FFCV. Leaching should also be avoided if, for example, a germicide, fungicide or UV stabilizer is incorporated into the coating. A loss of it by leaching might compromise the desired result being sought. Other considerations as to the coating selected will be readily apparent to the skilled artisan depending upon the nature of the cargo being transported and the end result desired.

Suitable polymeric coating materials include polyvinyl chloride, polyurethanes, synthetic and natural rubbers, polyureas, polyolefins, silicone polymers and acrylic polymers. These polymers can be thermoplastic or thermoset in nature. Thermoset polymeric coatings may be cured via heat, room temperature curable or UV curable. The polymeric coatings may include plasticizers and stabilizers that either add flexibility or durability to the coating. The preferred coating materials are plasticized polyvinyl chloride, polyurethanes and polyureas. These materials have good barrier properties and are both flexible and durable.

Suitable fiber reinforcement materials are nylons (as general class), polyesters (as a general class), polyararnids (such as Keviar®, Twaron® or Technora®), polyolefins (such as Dyneema® and Spectra® which are made of ultra high molecular weight polyethylene) and polybenzoxazole (PBO).

Within a class of material, high strength fibers minimize the weight of the fabric required to meet the design requirement for the FFCV. The preferred fiber reinforcement materials are high strength nylons, high strength polyaramids and high strength polyolefins. PBO is desirable for it's high strength, but undesirable due to its relative high cost. High strength polyolefins are desirable for their high strength, but difficult to bond effectively with coating materials.

Accordingly, with all of the foregoing in mind, the appropriate fiber and weave may be selected along with the coating to be used.

Turning now to a method of rendering such a large structure impermeable, there are several ways to accomplish this which are set forth in the aforesaid patent applications and will not be repeated herein.

However, as discussed in the aforesaid applications, one of the methods for coating the tube employs a thermoplastic composite approach. The tube is woven from a mixture of at least two fibrous materials. One material would be the reinforcing fiber and the second material would be a low melting fiber or low melting component of a reinforcing fiber. The low melting fiber or component might be a thermoplastic polyurethane or polyethylene. The reinforcing fiber might be polyester or nylon tire cord or one of the other fibers hereinbefore discussed. The tube would be subjected to heat and pressure in a controlled fashion. This heat and pressure would cause the low melting fiber or component to melt and fill the void in the woven structure. After the heat and pressure are removed and the structure is cooled, a composite structure would form in which the low melting fiber or component has become the matrix for the reinforcing fiber. This approach requires applying heat and pressure while also providing a means to keep the inner surfaces of the tube from adhering or thermally bonding to each other.

Figure 2:
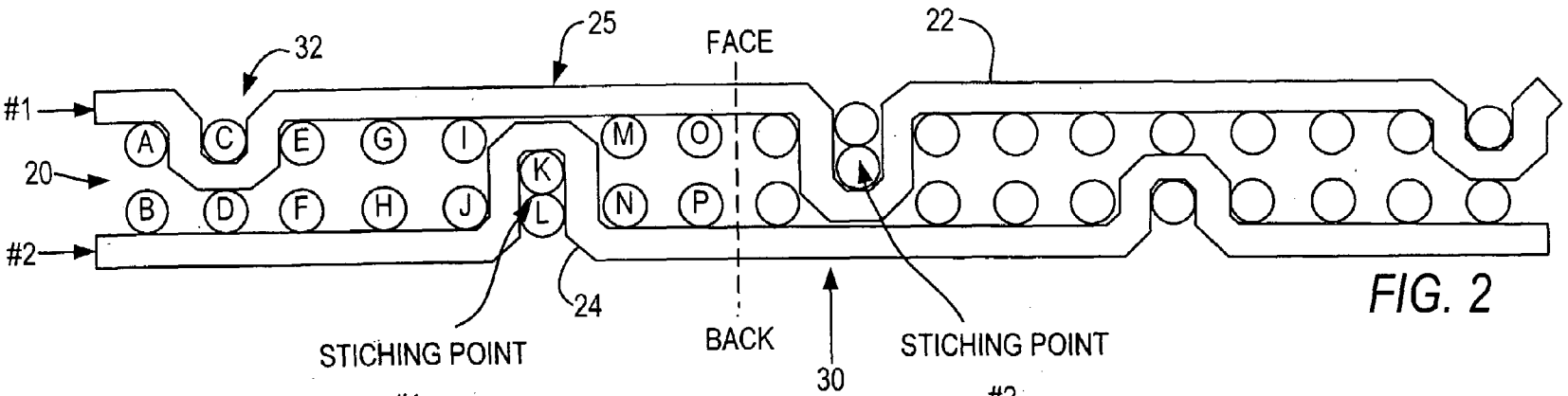
FIG. 2 is a side sectional view of a fabric incorporating the teachings of the present invention.
Figure 2B:
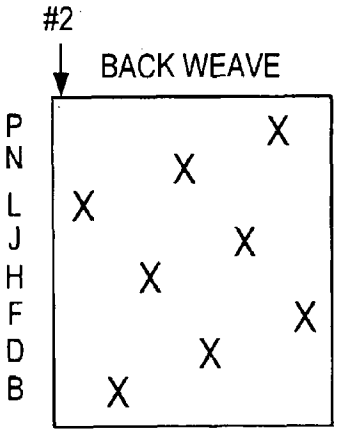
FIGS. 2A and 2B illustrate the stitching points of the front and back weave of the fabric shown in FIG. 2 incorporating the teachings of the present invention.
Figure 2A:
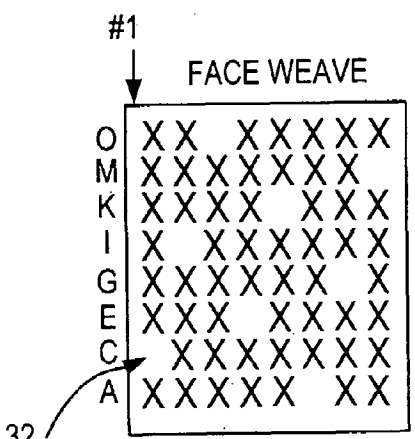

The present invention is directed to a variation thereof so as to provide for a fabric having two different coatings on opposite sides of the fabric. In this regard, the method involves applying a coating to the fibers or yarns that make up the fabric 20 prior to the weaving operation. The face fibers 22 are coated with one type of thermoplastic compound and said back fibers 24 are coated with a different thermoplastic compound as shown in FIG. 2. The weaving process selectively interlaces all the fibers with one type of coating on the face side 26 and all the fibers of another coating on the backside 30. The two layers are bound together by a weaving technique called stitching points. This stitching point technique is illustrated when viewing FIG. 2 in combination with FIGS. 2A and 2B. In this regard, fibers 22 and 24, which have the thermoplastic coating, have the great majority of their length on surfaces 26 and 30 respectively. This is due to the use of stitching points 32 in the weave. While the weave shown is generally referred to as an 8 harness, satin double cloth with stitching points, any weave suitable for the purpose can be used.

The core fibers, prior to coating with the thermoplastic material, can be made of polyamide, polyester, aramid, polyolefin, rayon, fiberglass or any yarn system compatible with fiber coating systems. The coating of this core fiber is done in a fashion known to those skilled in the art. There are many denier sizes that could be used ranging from 210 denier all the way to 10,000 denier depending on the thickness of the fabric desired and the strength requirement that must be achieved.

The thermoplastic coating can be a urethane, polyester, polyamide, polyvinyl chloride, polyolefin, or the like. The melting temperature of the coating material must be substantially lower than the melting temperature of the core fiber so there is no damage to the core fiber during coating application or post heat treating.

One very common coated fiber is that of polyvinyl chloride (PVC) over polyamide multifilament. This fiber is traditionally used to fabric braid electrical wire harnesses. Another common coated fiber is thermoplastic urethane coated over polyamide multifilament. This fiber is traditionally used in the manufacture of outdoor furniture. Both of these fibers can be woven on the large papermaker clothing looms to produce a structure that is a double cloth weave with stitching points in an endless form. The resulting structure is tubular and contains no seams but is still permeable to water and air. To render the woven fabric impermeable to air and water it must be treated with heat and moderate pressure to make the coatings flow on the individual fibers. Each coating system will flow on the respective side of the fabric and create a homogeneous barrier to air and water. After the tube is woven, the coatings on the fibers 22 and 24 are liquified by being subject to heat and pressure.

Figure 5:
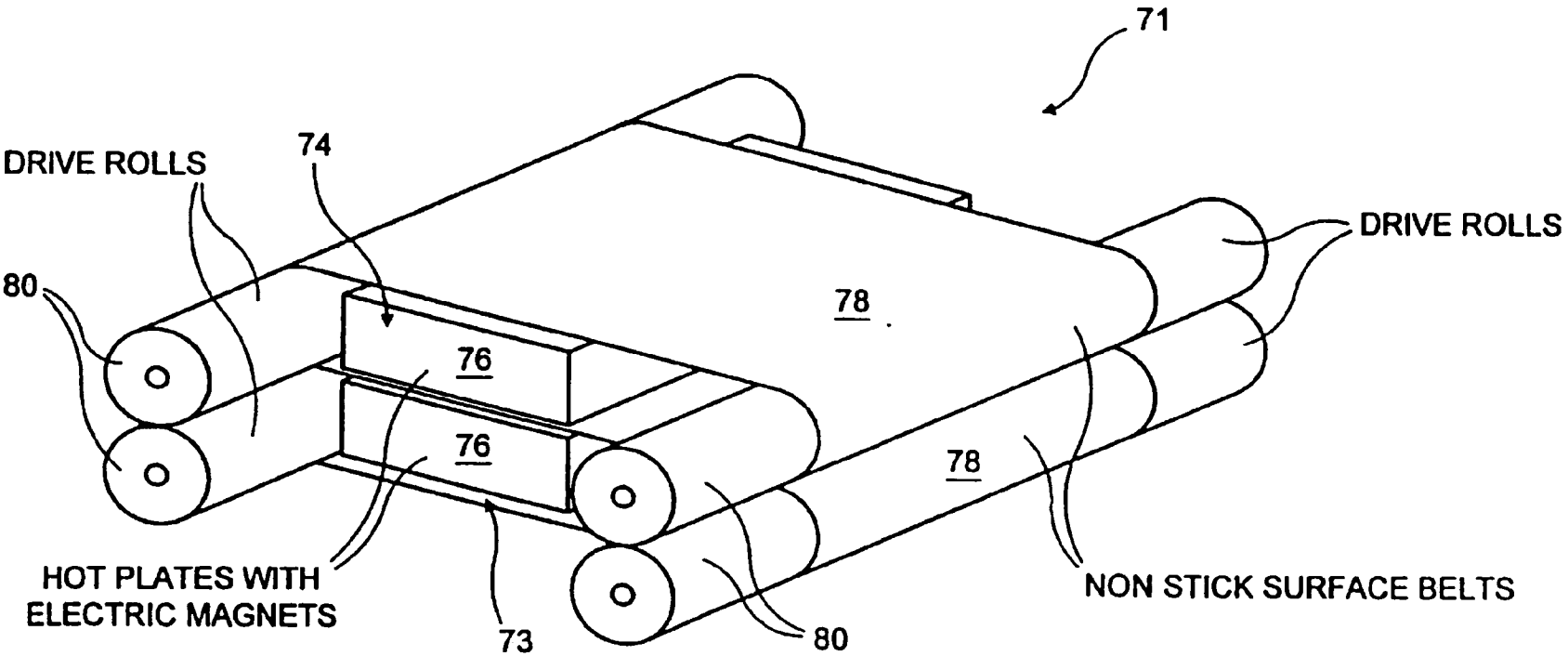
FIG. 5 is a perspective view of a device for applying heat and pressure to a tube which is to be used in an FFCV incorporating the teachings of the present invention.
Figure 6:
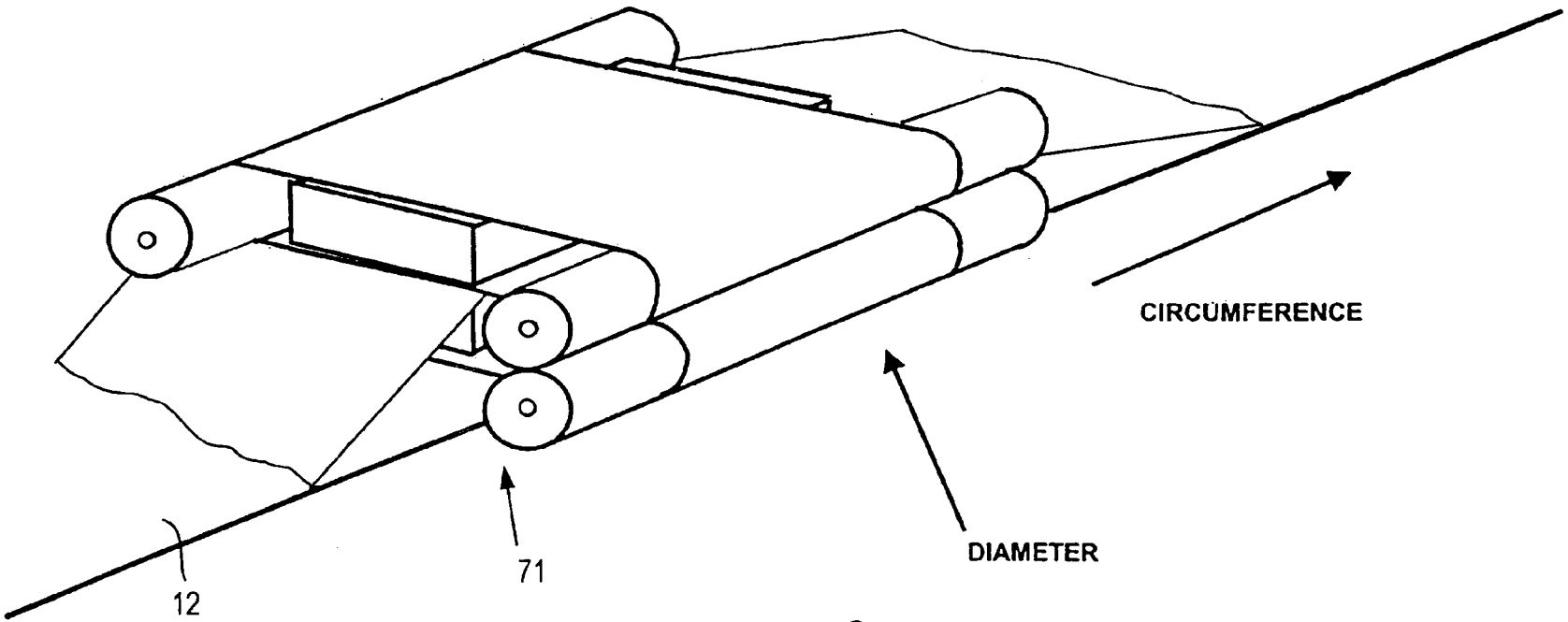
FIG. 6 is a perspective view of the device shown in FIG. 5 in conjunction with the tube incorporating the teachings of the present invention.

One way to do this is set forth in the second aforesaid patent application and involves a device 71 shown in FIGS. 5 and 6 which can apply heat and pressure to the tube 12. The device 71 can be self-propelled or can be moved by external pulling cables. Each section 73 and 74 of the device includes heating or hot plates with respective magnets 76 and motors (not shown) and are positioned on either side of the fabric as shown in FIG. 6. A power supply (not shown) is provided to energize the heating plates 76 and supply power to the motors that propel the device across the tube 12. The magnets serve to pull the two hot plates 76 together which creates pressure to the fabric as the coating on the yarn liquefies from the heat. These magnets also keep the top heating plate 76 opposite to the inside heating plate 76. The device 71 includes endless non-stick belts 78 that ride on rollers 80 located at the plate ends. The belts 78 ride over the plates 76. In this way there is no movement of the belt 78 in relation to the fabric surface when it is in contact with the fabric. This eliminates smearing of the melted coating and uniform distribution between the yarns. The device moves across the length of the tube 12 at a speed that enables the melted coat to set prior to the fabric folding back upon itself and sticking. If faster speeds are desired, a means for temporarily keeping the inside surfaces apart while setting takes place, may be implemented. This may be, for example, a trailing member on the inside of the tube of similar design to that described but being only one section without, of course, a heating plate or magnet. Other means suitable for this purpose will be readily apparent to those skilled in the art.

In view of the closed nature of the FFCV, if it is intended to transport fresh water, as part of the coating process of the inside thereof, it may provide for one of the coatings to include a germicide or a fungicide so as to prevent the occurrence of bacteria or mold or other contaminants.

In addition, since sunlight also has a degradation effect on fabric, the FFCV may include as part of its outside coating a UV protecting or stabilizing ingredient in this regard.

Turning now to a further embodiment for coating the FFCV, an FFCV constructed from materials such as, for example, nylon, polyester and rubber would have a density greater than salt water. As a result the empty FFCV or empty portions of the large FFCV would sink. This sinking action could result in high stresses on the FFCV and could lead to significant difficulties in handling the FFCV during filling and emptying of the FFCV. The use of a coating, which provides buoyancy, provides an alternative to mechanical buoyancy devices.

As aforesaid, it is desirable that the FFCV float when empty of cargo. This may be accomplished by any number of means including those set forth in the patent applications noted earlier. Including therein is to coat the FFCV with a foam. By using a foam coating, one could lower the overall density of the coated fabric to below 1.0 g/cm$^3$, since the yarns or fibers used such as polyester and coating resins, such as polyvinyl chloride have densities greater than 1.0 g/cm$^3$. Foamed coatings usually involve generating a large amount of gas chemically in the coating or by purposely beating air into the coating by a mechanical device. Applying foam has its advantages and may be desirable under certain circumstances. Applying foam also has some drawbacks, since it is difficult to control penetration, uniformity and thickness. Also, foam has less abrasion resistance and mechanical strength to that of a non-foamed resin coating.

A proposed alternative, in addition to foaming, is to incorporate microspheres into the coating. There are generally two types of microspheres—glass and polymeric. The bulk densities are as low as 0.01 g/cm$^3$ with mean particle size ranges of about 100 microns. Such microspheres are manufactured by 3M and PQ Corp. PQ Corp. sells plastic microsphere filler under the designation PM 6545 and PM 6550.

PM 6545 and PM 6550 are produced from a copolymer consisting of polyacrylonitrile and polymethacrylonitrile. The plastic spheres products are resistant to solvents and resins. The following is a table of their characteristics.

TABLE 1

| Product | Density (g/cc) | | Volume Particle Size (μ) | | Working Pressure |
|---|---|---|---|---|---|
| Grade | Bulk | Effective | Mean | Range | (psi) |
| PM 6545 | 0.009 | 0.020 | 110 | 10-250 | 2000 |
| PM 6550 | 0.010 | 0.022 | 100 | 10-250 | 2000 |

PQ Corp. also supplied a hollow, glass microsphere, Q-Cel 6019S. This material is easier to work with but is somewhat denser at 0.19 g/cm$^3$.

As can be seen in the following example, by providing 14% loading of microspheres by volume, the densities of the coating were reduced to 0.95 g/cm$^3$. Note that the desired overall density for the finished product and the necessary loading will vary depending upon the resin and the fabric. Also, while the physical properties of the coating are lower, it should not be so low so as to effect the integrity of an FFCV.

EXAMPLE

Resin and Curative:

Adiprene® LF 950 (urethane prepolymer)—1.13 g/cm$^3$

Ethacure® 100 (curative)—1.022 g/cm$^3$

For 95% stochiometry, 11 parts of Ethacure 100 was mixed with 100 parts of Adiprene. Note, the amount of microspheres used was based only with regard to the Adiprene. The curative should, however, also be taken into account.

To float in water, the polyurethane coating must have a density of less than 1.0 g/cm$^3$. A density 0.95 g/cm$^3$ would be effective. Note that the density of the fabric should also be taken into account. In practice, the urethane will need to be low enough in density to float both it and the fabric to which it has been applied.

TABLE 2

| formulation information | | | | |
|---|---|---|---|---|
| Sample ID | Adiprene LF 950 | Ethacure 100 | PM 6550 | Q-Cel 6019S |
| 5017-08A | 100 g | 11 g | X | X |
| 5017-08B | 100 g | 11 g | 0.38 g | X |
| 5017-08C | 100 g | 11 g | X | 3.13 g |

| Sample ID | Density (calculated) | Microsphere % by volume |
|---|---|---|
| 5017-08A | −1.13 | X |
| 5017-08B | −0.95 | 14.8 |
| 5017-08C | −0.95 | 14.3 |

The microspheres were mixed into the Adiprene prepolymer without much difficulty. The PM 6550 microspheres were more difficult to work with due to their low density. Samples of each resin mix were cast into molds, allowed to cure, trimmed to size, and then tested for tensile strength.

Figure 3:
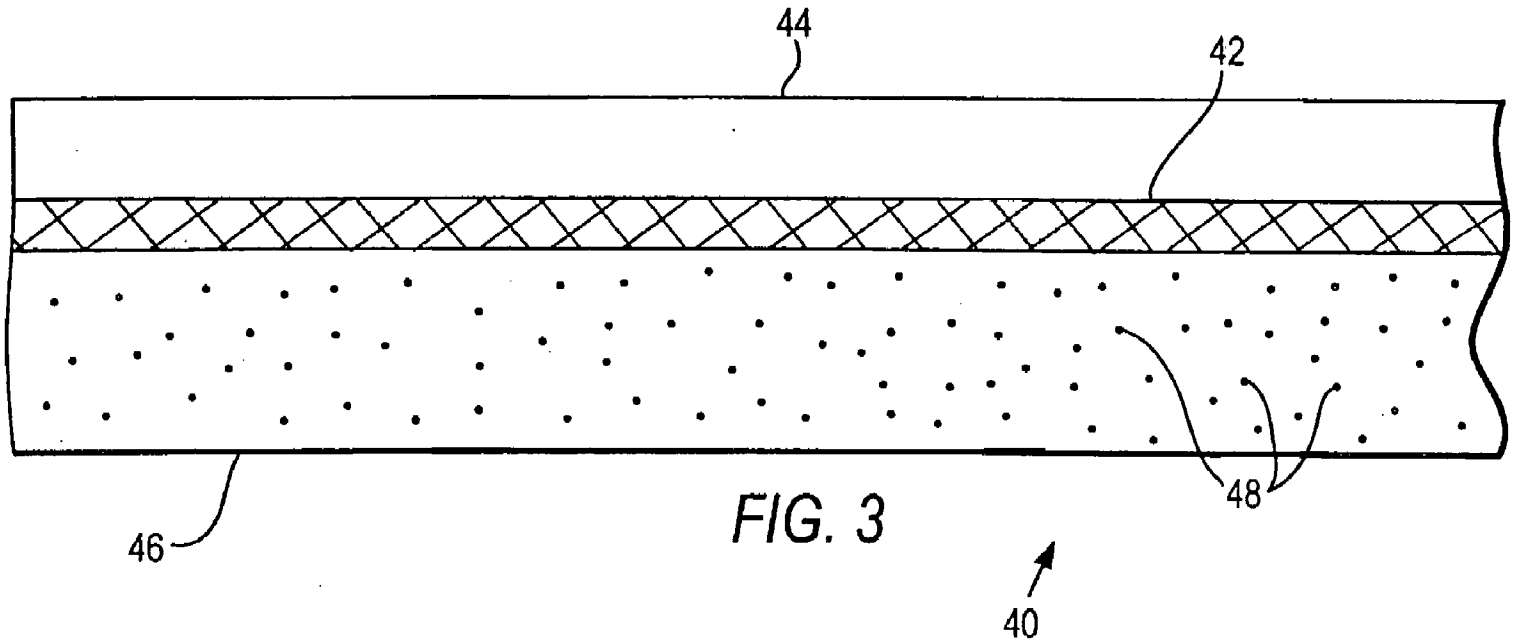
FIG. 3 is a side sectional view of a coated fabric incorporating microspheres in its coating, incorporating the teachings of the present invention.
Figure 3A:
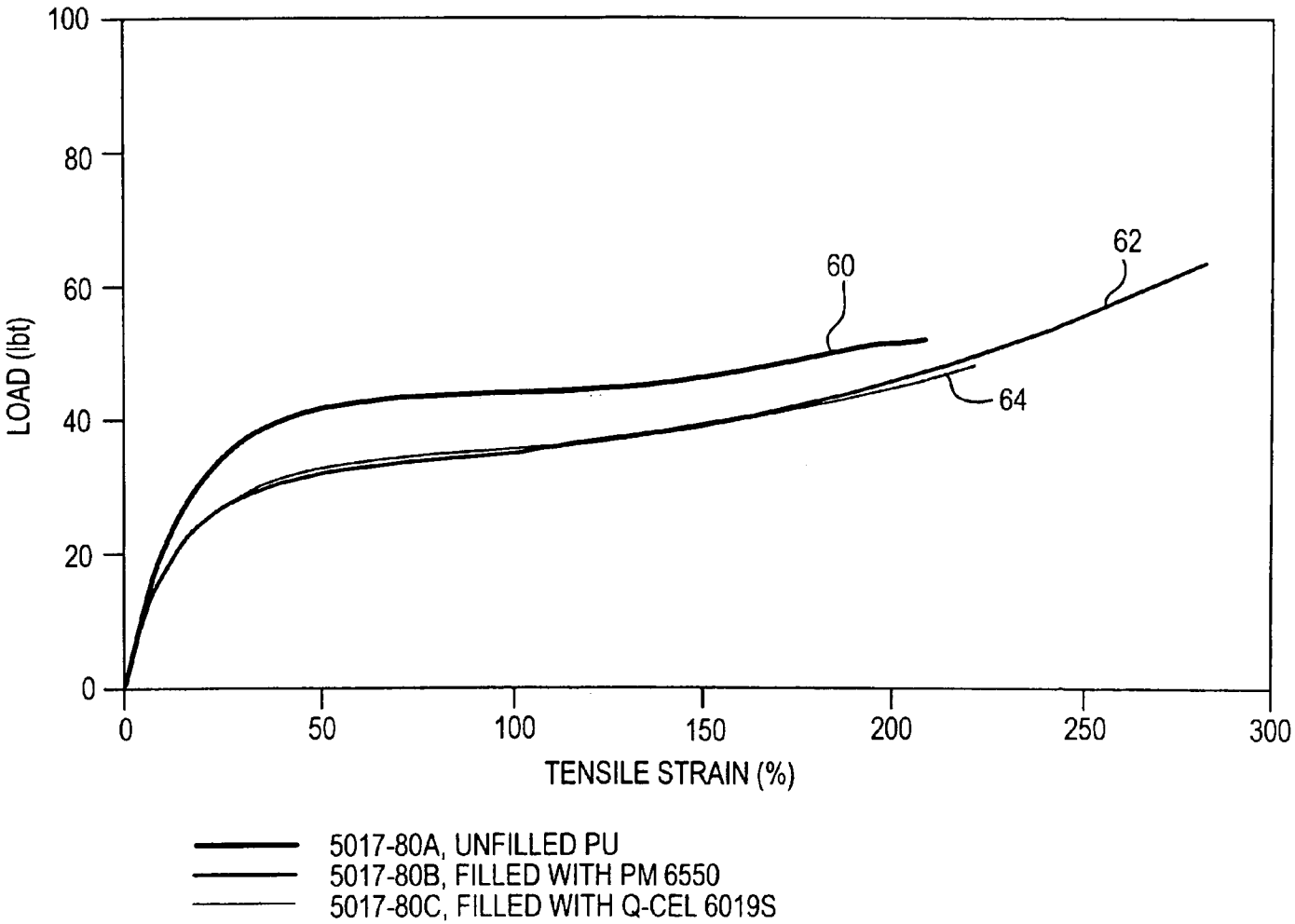
FIG. 3A is a graph illustration of a stress strain curve for resin without microsphere and with two different microspheres.

There was some reduction in strength of the coating for both the PM 6550 and the Q-Cel 6019S observed as can be seen in FIG. 3A. In this regard, unfilled resin is illustrated by line 60, resin filled with PM 6550 is illustrated by line 62 and resin filled with Q-Cel 6019S being illustrated by line 64. Tests for flexibility and abrasion should also be performed.

Accordingly, by incorporation of microspheres, it will decrease the density of a resin to the point of buoyancy in seawater. Resin properties will be affected but should be adequate for the requirements of the particular application. It should be noted that spray application of polyurethanes and in particular, polyureas is typically done at high pressure, i.e. in excess of 1000 psi. The microspheres selected should be capable of handling such pressures.

FIG. 3 shows a coated fabric 40. In this regard, there is a base substrate 42 which may be woven, knit or braided from a desired yarn or fiber. The fabric 40 is coated on both sides 44 and 46 with the desired resin. Incorporated into the resin prior to its being applied (via spraying, etc.) are the microspheres 48 as aforedescribed. The microspheres 48 are randomly disbursed in the coating and create sufficient voids such that the overall density of the fabric 40 is less than 1 g/cm$^3$. Accordingly, an FFCV made with such a fabric will float in salt water with or without a cargo of fresh water.

Figure 4:
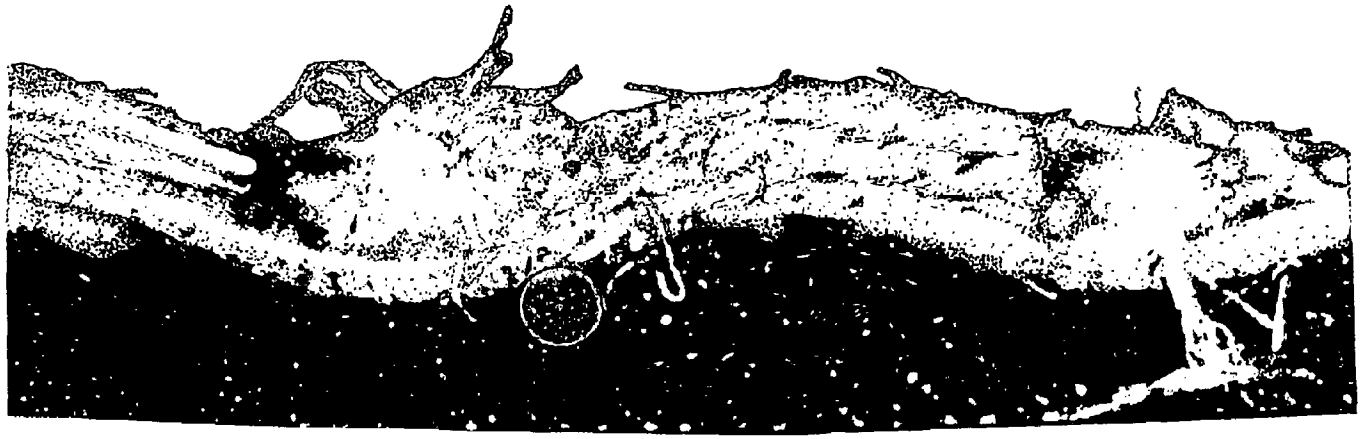
FIG. 4 is a side sectional view of a coated fabric having an air entrained coating, incorporating the teachings of the present invention.
Figure 4A:
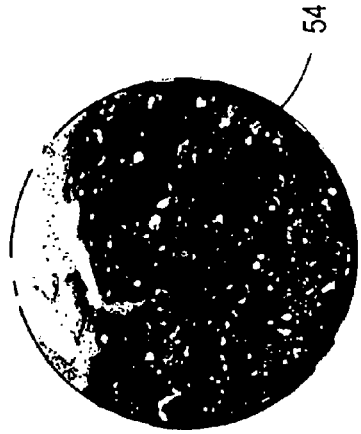
FIG. 4A is an enlargement of a portion of the coating shown in FIG. 4 incorporating the teachings of the present invention.

Turning now to an alternative means of rendering the fabric buoyant, in this regard reference is made to FIGS. 4 and 4A. In many applications, in general, where a coating is being applied, entrained air in the coating is undesirable. This is in contradistinction to a foam coating as aforementioned, and steps are often undertaken to prevent entrained air from becoming entrapped in the coating.

The present invention is just the reverse of this. In order to reduce the overall density of the coated fabric 50 air is allowed to become entrapped within the coating 52. As can be seen in FIG. 4A, air bubbles 54 of random size and placement are entrapped in the coating 52. The amount of entrapped air necessary will vary depending upon the density of the fibers and the resin used. The goal is, however, to have the overall density of the coated fabric to be less than 1 g/cm$^3$.

For example, a fabric was woven from ultra-high molecular weight polyethylene (UHMWPE) fiber (tradenames for these are Spectra® or Dyneema®) and then coated with a spray-applied, 2 component polyurethane system containing no fibers, simply a pure polyurethane coating.

Although it was expected that the UHMWPE fabric would float (density 0.97 g/cm$^3$), it was also expected that after coating with polyurethane (density of approximately 1.17 to 1.27 g/cm$^3$), any floating characteristics of the fabric would be negated by the much denser coating. Coating add-on is at least 1:1 and more typically, 2 and even 3:1 coating to fabric ratio.

When a sample of spray coated fabric was placed in water, it floated. Since the coating was applied via a spray process, air was trapped in the coating during spraying, effectively reducing the density to something less than 1.0 g/cm$^3$. Note that coating density will vary depending particularly on spraying conditions. Also, the density of the coated fabric will vary depending on the coating to fabric ratio.

As in the case of microspheres, there is a trade off in the mechanical strength of the coated fabric with the advantage of the fabric's ability to float. Obviously, such a trade off should not be to such an extent that the integrity of the FFCV is compromised.

Also, in either situation, it may be desirable to have the filled coatings having entrained air or microspheres on top of or beneath an unfilled coating. The filled coatings could also be sandwiched between the unfilled coatings or any variations along these lines, such as coating the interior of the tube with filled coating and the exterior of the tube with unfilled coating. The variations are endless.

In addition, it may be desirable to have the entire tube coated with filled coatings or only a portion thereof or at selected locations with the other portions or locations coated with an unfilled coating. All of this would depend on the desired results being sought.

Although preferred embodiments have been disclosed and described in detail herein, their scope should not be limited thereby rather their scope should be determined by that of the appended claims.

We claim:

1. A flexible fluid containment vessel for the transportation and/or containment of cargo comprising a fluid or fluidisable material, said vessel comprising:

an elongated flexible tubular structure comprised of fabric having a first side and a second side;

said tubular structure being impervious and having a front end and a rear end;

means for sealing said front end and said rear end;

means for filling and emptying said vessel of cargo; and means for rendering said tubular structure buoyant comprising forming said fabric having at least one thermoplastic or thermoset coating that renders the fabric buoyant, wherein a first thermoplastic or thermoset coating is on said first side of the fabric and a second thermoplastic or thermoset coating is on said second side of the fabric with said first thermoplastic or thermoset coating being different from said second thermoplastic or thermoset coating with said coatings being taken from the group consisting essentially of polyurethanes, polyester, polyamide, polyvinyl chloride, polyolefins, synthetic and natural rubbers, polyureas, silicone polymers, acrylic polymers or foam derivatives thereof or other suitable thermoplastic or thermoset material.

2. The vessel in accordance with claim 1 wherein said fabric is woven and said first and second sides are formed by stitching points.

3. The vessel in accordance with claim 1 wherein said fabric is formed out of yarns, and said at least one thermoplastic or thermoset coating is subject to heat, pressure or both to cause it to flow and fill voids in said fabric.

4. The vessel in accordance with claim 1 wherein said one or both coatings have microspheres therein in a sufficient amount that the overall density of the coated fabric is less than approximately 1.0 g/cm$^3$.

5. The vessel in accordance with claim 1 wherein said one or both coatings have a gas or entrained thereon such that the gas or air is trapped therein is in sufficient amount that the overall density of the coated fabric is less than approximately 1.0 g/cm$^3$.

6. The vessel in accordance with claim 5 wherein the coating is applied to the fabric by spraying or in the form of a foam.

7. The vessel in accordance with claim 1 wherein the fabric includes fibers or yarns made from material consisting essentially of ultra high molecular weight polyethylene, or polyolefins; and the means for rendering said tubular structure buoyant comprises coating said fabric with a polyurethane material.

8. The vessel in accordance with claim 7 wherein said coating is a thermoset polyurethane coating.

* * * * *